US012677958B2

(12) United States Patent
Ritzel

(10) Patent No.: US 12,677,958 B2
(45) Date of Patent: Jul. 14, 2026

(54) MATTRESSES WITH COMFORT AND STABILITY ZONES

(71) Applicant: BLUE BELL MATTRESS COMPANY, LLC, East Windsor, CT (US)

(72) Inventor: Derek August Ritzel, Greensboro, NC (US)

(73) Assignee: BLUE BELL MATTRESS COMPANY, LLC, East Windsor, CT (US)

( * ) Notice: Subject to any disclaimer, the term of this patent is extended or adjusted under 35 U.S.C. 154(b) by 119 days.

(21) Appl. No.: 18/586,161

(22) Filed: Feb. 23, 2024

(65) Prior Publication Data

US 2025/0268388 A1 Aug. 28, 2025

(51) Int. Cl.
*A47C 27/05* (2006.01)
*A47C 27/12* (2006.01)

(52) U.S. Cl.
CPC ..... *A47C 27/056* (2013.01); *A47C 27/12* (2013.01)

(58) Field of Classification Search
CPC ..... A47C 27/056; A47C 27/12; A47C 27/121; A47C 27/148; A47C 27/15; A61G 7/05715
USPC ..... 5/727, 740
See application file for complete search history.

(56) References Cited

U.S. PATENT DOCUMENTS 112,175 A * 2/1871 Van Horn et al. ... A47C 27/148 5/951
3,146,469 A * 9/1964 Slade ..... A47C 27/15 5/699
3,521,311 A * 7/1970 Cohen ..... A47C 27/15 5/727
3,846,857 A * 11/1974 Weinstock ..... A47C 27/15 5/722
4,053,957 A * 10/1977 Regan ..... A47C 23/00 5/727
4,706,313 A * 11/1987 Murphy ..... A47C 27/148 5/737
4,947,500 A * 8/1990 Seiler ..... A47C 27/18 5/713
4,999,868 A * 3/1991 Kraft ..... A47C 27/146 5/736

(Continued)

FOREIGN PATENT DOCUMENTS

WO 2000065964 A1 11/2000

OTHER PUBLICATIONS

PR Newswire, "Bedsure Experts Introduces The Mattress Topper Series for Optimal Spinal Support," URL: https://www.prnewswire.com/news-releases/bedsure-experts-introduces-the-mattress-topper-series-for-optimal-spinal-support-301428969.html; web page visited Jul. 22, 2025.

(Continued)

*Primary Examiner* — David R Hare
(74) *Attorney, Agent, or Firm* — Perkins Coie LLP

(57) ABSTRACT

A mattress may include a first section extending from the head end by a distance between 15 to 19 inches, and a second section adjacent to the first section and extending from the first section by a distance of 31 to 35 inches. In some embodiments, the first section includes a different material than the second section. The second section may include coil springs, foam, one or more air chambers, or a combination thereof.

32 Claims, 2 Drawing Sheets

(56) References Cited

U.S. PATENT DOCUMENTS

| | | | | |
|---|---|---|---|---|
| 5,107,558 | A * | 4/1992 | Luck | A47C 27/15 5/702 |
| 5,136,740 | A * | 8/1992 | Kraft | A47C 27/15 5/736 |
| 5,231,717 | A * | 8/1993 | Scott | A47C 31/123 5/400 |
| 5,398,354 | A * | 3/1995 | Balonick | A47C 27/20 5/922 |
| 5,644,811 | A | 7/1997 | Cavazos | |
| 5,896,605 | A | 4/1999 | Branman | |
| 6,055,689 | A | 5/2000 | Cavazos | |
| 7,191,483 | B2 * | 3/2007 | Hochschild | A47C 27/15 5/691 |
| 7,386,903 | B2 * | 6/2008 | Hochschild | A47C 31/105 5/691 |
| 7,469,437 | B2 * | 12/2008 | Mikkelsen | A47C 27/148 5/724 |
| 7,707,670 | B2 * | 5/2010 | Fogg | A47C 27/15 5/691 |
| 7,865,989 | B2 * | 1/2011 | Steppat | A47C 27/15 5/727 |
| 8,490,233 | B2 * | 7/2013 | Essers | A61G 7/05715 5/724 |
| 9,854,922 | B1 * | 1/2018 | Schiller | A47C 27/15 |
| 9,949,573 | B1 * | 4/2018 | Huang | A47C 27/15 |
| 10,357,115 | B2 * | 7/2019 | Oh | A47C 27/148 |
| 11,006,765 | B2 * | 5/2021 | Vester, III | A47C 27/15 |
| 11,224,296 | B2 * | 1/2022 | Micklos | A47C 27/20 |
| 11,786,051 | B2 * | 10/2023 | Andrew | A47C 27/056 5/717 |
| 2002/0178503 | A1 | 12/2002 | Reeder et al. | |
| 2003/0000014 | A1 | 1/2003 | Sopher et al. | |
| 2003/0041381 | A1 | 3/2003 | Taymon | |
| 2006/0048304 | A1 * | 3/2006 | Boyd | A47C 27/15 5/738 |
| 2007/0022540 | A1 * | 2/2007 | Hochschild | A47C 27/001 5/738 |
| 2010/0170042 | A1 * | 7/2010 | Rose | A47C 27/148 5/739 |
| 2012/0124753 | A1 * | 5/2012 | Lee | A47C 27/15 29/428 |
| 2012/0311785 | A1 | 12/2012 | Goldberg | |
| 2013/0081208 | A1 * | 4/2013 | Dyevich | A47C 27/144 5/727 |
| 2015/0305514 | A1 * | 10/2015 | Kulju | A47C 27/05 5/727 |
| 2016/0193096 | A1 * | 7/2016 | Dyevich | A61G 7/05723 5/727 |
| 2017/0156508 | A1 * | 6/2017 | Segal | A47C 27/001 |
| 2018/0279795 | A1 * | 10/2018 | Murphy | A47C 27/002 |
| 2022/0095806 | A1 * | 3/2022 | Nguyen | A47C 27/001 |

OTHER PUBLICATIONS

Organic Textiles, "Find out which topper "zone" is perfect for you," "What are "zones" in a mattress topper?" URL: https://www.organictextiles.com/blogs/news/find-out-which-topper-zone-is-perfect-for-you; web page visited Jul. 22, 2025.

American Bedding Mfg., "What is the 16 CFR 1633 and Why Is It Important?", URL: https://info.americanbeddingmfg.com/what-is-the-16-cfr-1633-and-why-is-it-important; Dec. 3, 2019.

quickzip.com, "Fitted Sheets—QuickZip Sheet", URL: https://quickzip.com/pages/fittedsheet; web page visited Mar. 11, 2022.

Tempurpedic, "TEMPUR-Adapt Mattress Collection", URL: https://www.tempurpedic.com/shop-mattresses/adapt-collection/v/2602/; web page visited Mar. 11, 2022.

United States Code of Federal Regulations, Title 16 CFR Part 1633, "Standard for the Flammability (Open Flame) of Mattress Sets," URL: https://www.ecfr.gov/current/title-16/chapter-II/subchapter-D/part-1633; web page visited Mar. 11, 2022.

* cited by examiner

MATTRESSES WITH COMFORT AND STABILITY ZONES

BACKGROUND

Conventional mattresses include a support portion beneath a comfort portion. Many mattresses use coils or dense foam for support, and lower-density foam or another soft material for comfort. The typical goal of mattress-design is providing support without excessive hardness to yield a comfortable mattress without misaligning the user's body and causing pain. Some mattresses include side-by-side zones to allow two users to have their own support and comfort configurations. Conventional mattresses, however, fail to adequately accommodate the specific needs of individual portions of a typical user's body.

SUMMARY

Representative embodiments of the present technology may include a mattress having a first section extending from the head end by a distance between 15 to 19 inches, and a second section adjacent to the first section and extending from the first section by a distance of 31 to 35 inches. In some embodiments, the first section includes a different material than the second section. The second section may include at least one of a foam material, a group of coil springs, or one or more other suitable support elements such as one or more air chambers.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the several views.

DETAILED DESCRIPTION

The present technology is directed to mattresses with comfort and stability zones, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures (such as internal mattress elements including padding or springs) or functions may not be shown or described in detail to avoid unnecessarily obscuring the relevant description of the various embodiments. Accordingly, embodiments of the present technology may include additional elements or exclude some of the elements described below with reference to FIGS. 1-5, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all the items in the list, or (c) any combination of items in the list.

Figure 1:
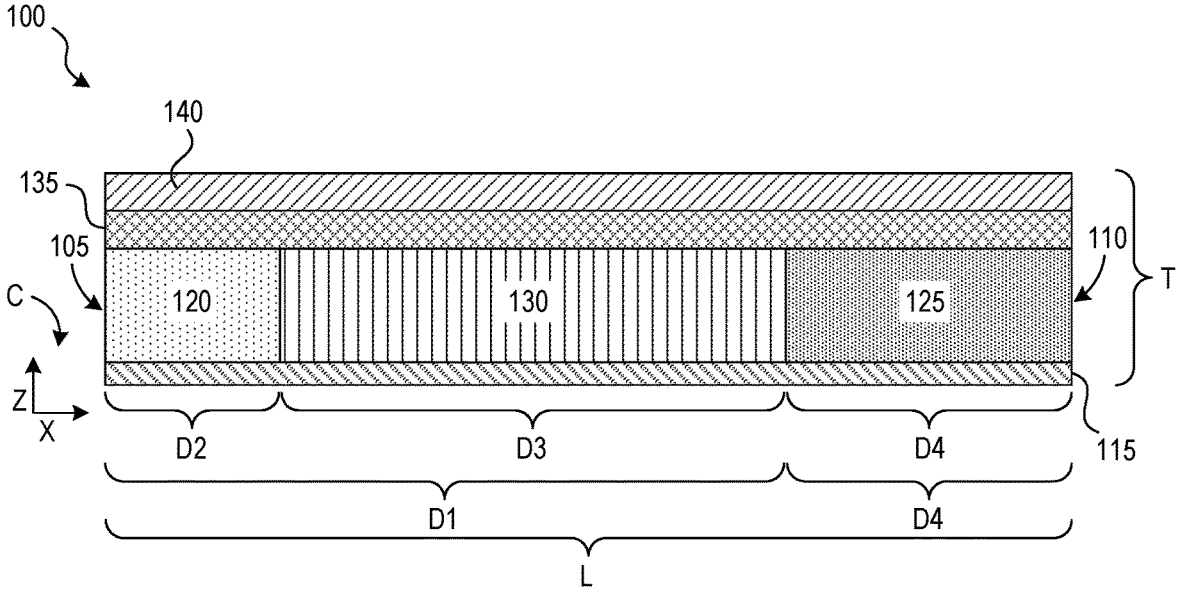
FIG. 1 illustrates a schematic side-sectional view of a portion of a mattress configured in accordance with embodiments of the present technology.
Figure 2:
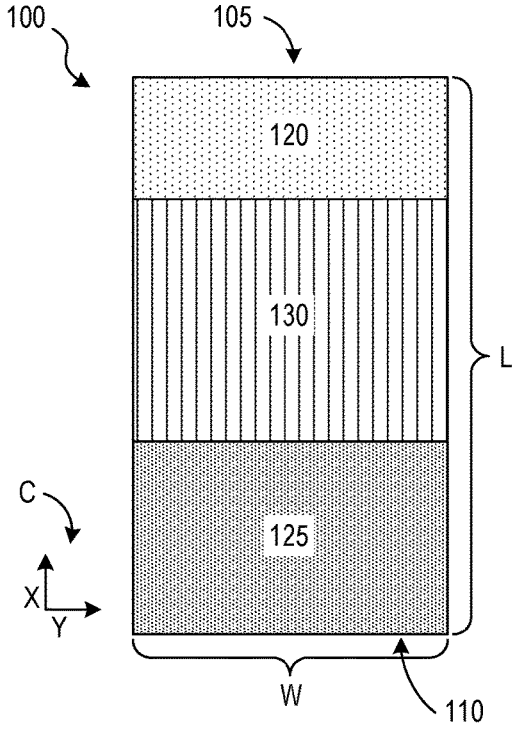
FIG. 2 illustrates a schematic top view of a portion of the mattress shown in FIG. 1.
Figure 3:
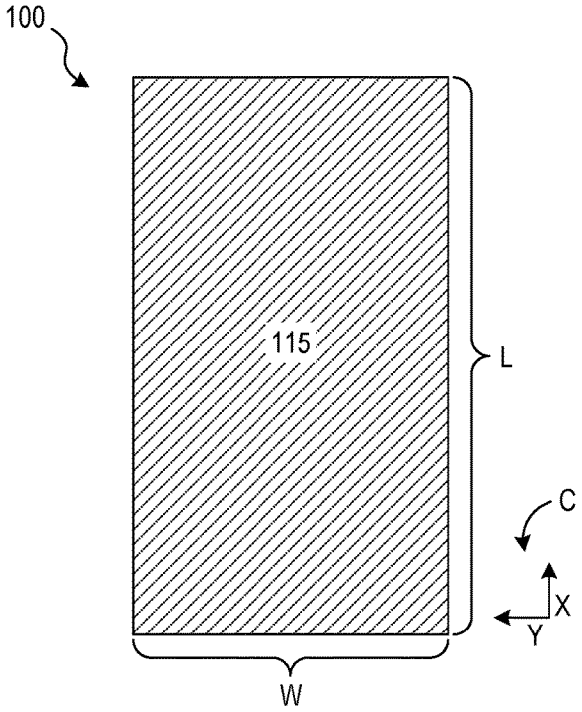
FIG. 3 illustrates a schematic bottom view of a portion of the mattress shown in FIG. 1.

FIG. 1 illustrates a schematic side-sectional view of interior elements of a mattress 100 configured in accordance with embodiments of the present technology. For purposes of description and dimensions, the interior elements shown in FIG. 1 are collectively referred to herein as the mattress 100, although it is understood that embodiments of the present technology my further include covers or containers around the components of the mattress 100. FIG. 2 illustrates a schematic top view of a portion of the mattress 100 shown in FIG. 1. FIG. 3 illustrates a schematic bottom view of the mattress 100 shown in FIG. 1. Each of FIGS. 1, 2, and 3 shows a coordinate system C solely for orienting the reader, and not for limiting the scope of the technology.

With reference to FIGS. 1, 2, and 3, in some embodiments, the mattress 100 may have a total length L along a longitudinal axis X extending between a head end 105 of the mattress 100 and a foot end 110 of the mattress 100. The mattress 100 may have a total width W along a lateral axis Y extending perpendicularly to the longitudinal axis X. The mattress 100 may also have a thickness T along a third axis Z perpendicular to the longitudinal axis X and perpendicular to the lateral axis Y. The length L may be greater than the width W, and the width W may optionally be greater than the thickness T. In use, a person may lie on the mattress 100 generally along the longitudinal axis X, with their head toward the head end 105, and their feet toward the foot end 110. In some embodiments, the mattress 100 may further include any suitable wrapping, covering, pillow topper, or other suitable containers or covers for containing the elements of the mattress 100 shown in FIG. 1.

In some embodiments, the mattress 100 may include a base portion 115 extending for most or all of the length L along the longitudinal axis X and extending for most or all of the width W along the lateral axis Y. The mattress 100 may further include a first support section 120 supported on the base portion 115 toward the head end 105, a second support section 125 supported on the base portion 115 toward the foot end 110, and a third support section 130 supported on the base portion 115 and positioned longitudinally between the first support section 120 and the second support section 125. In some embodiments, the support sections 120, 125, 130 may extend a full width of the mattress 100 along the Y axis.

The third support section 130 is positioned and configured to provide a different amount of support (e.g., softness, cushioning, or resilience) than the first support section 120 or the second support section 125. The third support section 130 is not necessarily positioned in the middle of the mattress 100 along the longitudinal axis X. Instead, the third support section 130 is positioned based on locations of features of the average human body, creating a support zone for the torso of most or all users. The present technology contrasts with typical and conventional mattresses that fail to account for actual human body proportions.

In some embodiments, the first support section 120 and the second support section 125 may include a foam material, one or more groups of coils, or other materials suitable for supporting a user's corresponding body parts (e.g., head and legs), such that when the materials are combined with the third support section 130 they provide whole-body support and pressure management corresponding to the weight distribution of the typical user. In some embodiments, the third support section 130 includes a structure or material that supports more weight than the first support section 120 without deforming as much as the first support section 120, such as a dense foam material, one or more air chambers, or a plurality of coil springs (e.g., "Marshall" springs) oriented to compress along the Z axis. In some embodiments, the base portion 115 may comprise high-density foam materials or fillers made of high-density fibers, each suitable for providing a structural base to support the elements on top of the base portion 115.

The inventor discovered that, for most adult humans, ideal or preferred sizing of the mattress 100 may include the first support section 120 and the third support section 130 together extending from the head end 105 of the mattress 100, along the longitudinal axis X, by a distance D1 of 48 inches to 52 inches, and in some particular embodiments, 50 inches. An ideal or preferred size of the mattress 100 may include the first support section 120 extending from the head end 105 of the mattress 100, along the longitudinal axis X, by a distance D2 of 15 to 19 inches, and in some particular embodiments, 17 inches. An ideal or preferred size of the mattress 100 may include the third support section 130 extending from the first support section 120, along the longitudinal axis X, by a distance D3 of 31 to 35 inches, and in some particular embodiments, 33 inches. An ideal size of the mattress 100 may further include the second support section 125 (if any) extending from the third support section 130, along the longitudinal axis X, by a distance D4 of 23 inches to 36 inches, although that value may vary depending on the size category of the mattress 100 (e.g., whether it is a twin, full, queen, king, California king, etc. sized mattress).

The distance D4 is typically the remaining length of the mattress after accounting for D2 and D3. Accordingly, the length D2 of the first support section 120 and the length D3 of the third support section 130 may generally be the same across multiple size categories of the mattress 100. In some embodiments, a ratio of the length D3 of the third section 130 along the longitudinal axis X, to the length D2 of the first section 120 along the longitudinal axis X, may be between 1.9:1 and 2.1:1, which enables scaling the dimensions of a mattress to accommodate a child, for example, while maintaining benefits of the present technology. In some embodiments, the base portion 115 may be one inch thick along the Z-axis, or other values, the support sections 120, 125, 130 may be eight inches thick along the Z-axis, or other values.

In some embodiments, the mattress 100 may further include one or more layers of comfort material on top of the support sections 120, 125, 130. For example, in some embodiments, the mattress 100 may include a first comfort layer 135 supported on the support sections 120, 125, 130, and the mattress 100 may further optionally include a second comfort layer 140 supported on the first comfort layer 135. A user may lie on first comfort layer 135 or the second comfort layer 140, if any. In some embodiments, the layers 135, 140 of comfort material may include foam having less density than the density of foam used in the first support section 120 or the second support section 125. The layers 135, 140 of comfort material may include foam materials, with each layer having a different density. In some embodiments, the comfort layers 135, 140 may be one to two inches thick, either cumulatively or independently, or other suitable dimensions, although layers that are too thick (e.g., layers 135, 140 being cumulatively about 12 inches thick or more) may undermine the effectiveness of the various support sections 120, 125, 130. The comfort layers 135, 140 may be individually or collectively deemed a "topper" portion. Other suitable materials for the comfort layers 135, 140 may include fibrous fillers, such as cotton, will, polyester, or other natural or synthetic fibers, or groups of coils configured in sheets suitable for use as a layer in a "topper" portion.

In use, the support sections 120, 125, 130 provide support for a human of average proportions, while the comfort layers 135, 140 provide a comfortable cushioning.

In a preferred embodiment, the mattress 100 does not include a top sheet or a scrim above the third support section 130 (e.g., above the coil springs in the third support section 130, but below the topper portion). Omitting the top sheet or scrim in this area allows the topper comfort layers 135, 140 and the components of the third support section 130 (e.g., coil springs) to move and flex with and relative to each other. A top sheet or scrim over the third support section 130 may diminish the desirable support properties of the third support section 130.

Figure 4:
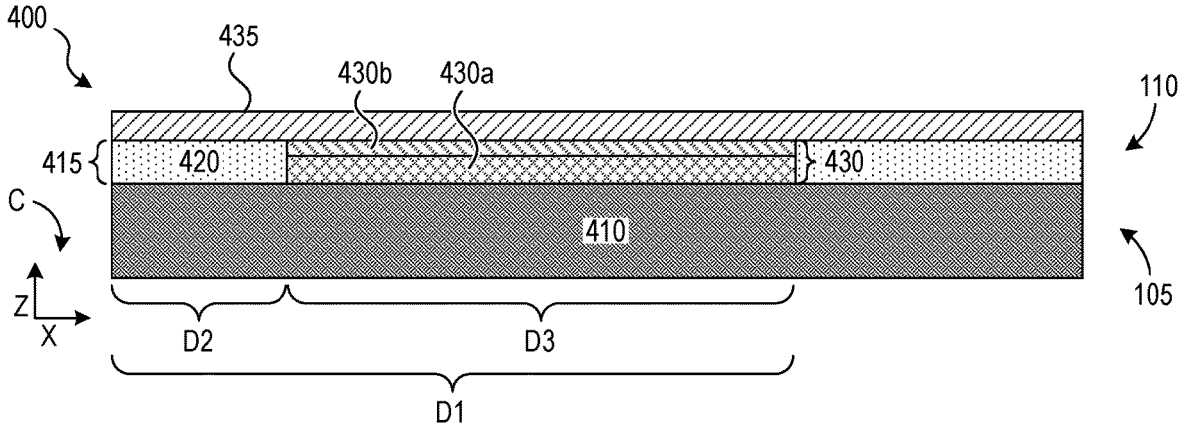
FIG. 4 illustrates a schematic side-sectional view of a portion of a mattress configured in accordance with additional embodiments of the present technology.

FIG. 4 illustrates a schematic side-sectional view of a mattress 400 configured in accordance with additional embodiments of the present technology. In some embodiments, the mattress 400 may include a first support layer 410, which may be in the form of a foam base extending a full length and width of the mattress 400, and extending a suitable height or thickness along the Z-axis, such as 7 inches to 8 inches, or another suitable dimension such as less than 7 inches (e.g., four inches). Comfort zones may be supported on the first support layer 410 in a first comfort layer 415. For example, the first comfort layer 415 may include a first comfort section 420 that extends from the head end by the distance D2.

A second comfort section 430 in the first comfort layer 415 may extend from the first comfort section 420 by the distance D3. The second comfort section 430 may include two comfort subsections 430*a*, 430*b*, which together may extend along the Z-axis by the same thickness as the first comfort section 420. The first comfort subsection 430*a* may be supported on the first support layer 410, and the second comfort subsection 430*b* may be supported on the first comfort subsection 430*a*. The subsections 430*a*, 430*b* may include foam, gel, coils, air in a membrane or bladder or other chamber, or other suitable materials for providing less compression resistance than the material forming the first comfort section 420. In some embodiments, the mattress 400 may further include a second comfort layer 435 supported on the first comfort layer 415, and extending a full length and width of the mattress 400. Accordingly, embodiments of the present technology may include mattresses that do not necessarily have coils, but still provide zoned support and comfort with the proportions described above with regard to FIGS. 1-3. In some embodiments, the first support layer 410 may include a coil base having a plurality of coils (e.g., Marshall coils) in addition to, or alternative to, the foam base.

Figure 5:
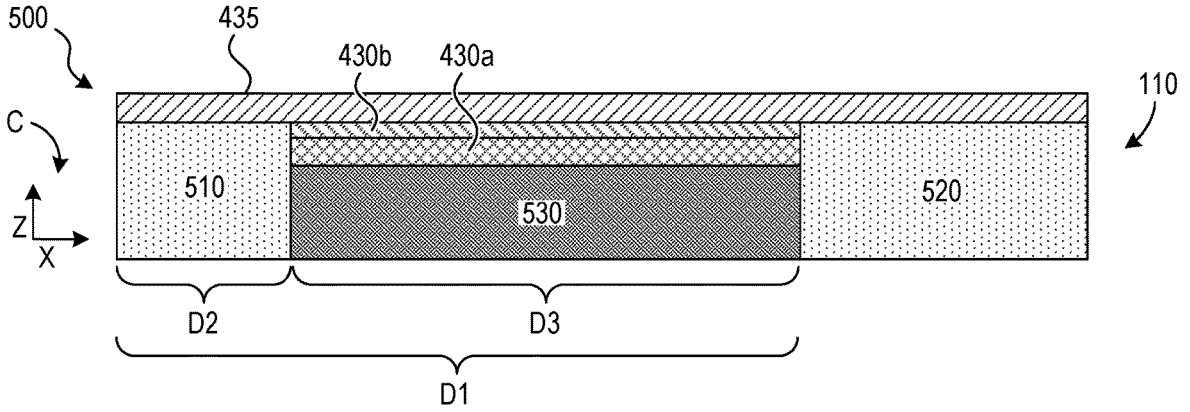
FIG. 5 illustrates a schematic side-sectional view of a portion of a mattress configured in accordance with additional embodiments of the present technology.

FIG. 5 illustrates a schematic side-sectional view of a mattress 500 configured in accordance with additional embodiments of the present technology. In some embodiments, the mattress 500 may be similar to the mattress 400 described above with regard to FIG. 4, except that a first section 510 may extend a full thickness of the mattress 500 along the Z-axis rather than being supported on a first support layer 410. A comfort section 520 adjacent to the foot end 110 of the mattress 500 may also extend the full thickness of the mattress 500. A foam base 530 may be similar to the foam base in the first support layer 410 of the mattress 400 shown in FIG. 4, except that it may only extend along the distance D3 beginning at the foot end of the first comfort section 510. The mattress 500 provides zoned support and comfort with the proportions described above with regard to FIGS. 1-3 that suit average adult humans, but without the use of coil springs, and with another alternative torso support area (i.e., the foam base 530 and the comfort subsections 430*a*, 430*b*). In some embodiments, a coil base may be substituted for the foam base 530.

Mattresses configured in accordance with embodiments of the present technology provide a comfortable section with minimal pushback for a user's head, while providing suitable support and pushback for a user's torso, which results in supporting a user's core and spine in a comfortable and aligned manner.

From the foregoing, it will be appreciated that specific embodiments of the presently disclosed technology have been described herein for purposes of illustration, but that various modifications may be made without deviating from the scope of the technology. For example, in some embodiments, a single mattress may include one or more parallel sections aligned along the Y-axis to accommodate co-sleepers with different preferences, where the sections have the disclosed support and comfort zones disclosed herein. In various embodiments, comfort sections or support sections may include foam, gel, coils, air in a membrane or bladder or other chamber, other materials disclosed herein, or other suitable materials, in various combinations. Foam materials disclosed herein may include polyurethane foam, viscoelastic memory foam, or other suitable foam materials. A latex material may be included in addition to, or instead of, the foam materials. Mattresses configured in accordance with embodiments of the present technology may include other combinations of features, or more or fewer features, than those disclosed herein.

Although specific quantities, dimensions, or other numerical characterizations are provided for context and/or to indicate representative embodiments, various further embodiments can have other quantities, sizes, or characteristics (for example, sizes, quantities, and/or characteristics commensurate with strength requirements or other variables). For purposes of the present disclosure, a first element that is positioned "toward" an end of a second element is positioned closer to that end of the second element than to a middle or mid-length location of the second element. Numerical adjectives including "first" and "second," or the like, as used in the present disclosure, do not convey hierarchy or specific features or functions. Rather, such numerical adjectives are intended to aid the reader in distinguishing between elements which may have similar nomenclature, but which may differ in position, orientation, or structure. Accordingly, such numerical adjectives may be used differently in the claims. As used herein, the terms "generally" and "approximately" refer to values or characteristics within a range of ±10% from the stated value or characteristic, unless otherwise indicated.

Certain aspects of the technology described in the context of particular embodiments may be combined or eliminated in other embodiments. Further, while advantages associated with certain embodiments of the presently disclosed technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

What is claimed is:

1. A mattress extending along (a) a longitudinal axis by a length between a head end of the mattress and a foot end of the mattress, (b) a lateral axis perpendicular to the longitudinal axis by a width of the mattress, and (c) a third axis perpendicular to the longitudinal axis and perpendicular to the lateral axis by a thickness of the mattress, wherein the length is greater than the width, and the width is greater than the thickness, the mattress comprising:

a base portion extending along the longitudinal axis by the length and along the lateral axis by the width, wherein the base portion comprises a first foam material;

a first support section supported on the base portion and extending along the lateral axis by the width, wherein the first support section comprises a second foam material;

a second support section supported on the base portion and extending along the lateral axis by the width, wherein the second support section comprises a third foam material;

a third support section supported on the base portion and positioned longitudinally between the first support section and the second support section, wherein the third support section extends along the lateral axis by the width and comprises a fourth foam material or a plurality of coil springs; and a comfort layer supported on the first, second, and third support sections, and extending along the longitudinal axis by the length and along the lateral axis by the width;

wherein:

the first support section extends from the head end of the mattress, along the longitudinal axis, by a first distance between 15 to 19 inches; and the third support section extends from the first support section, along the longitudinal axis, by a second distance of 31 to 35 inches.

2. The mattress of claim 1, wherein the first distance is 17 inches and the second distance is 33 inches.

3. The mattress of claim 1, wherein the first support section further comprises a plurality of coil springs.

4. The mattress of claim 1, wherein the comfort layer comprises a plurality of coil springs.

5. The mattress of claim 1, wherein the first support section, the second support section, and the third support section together extend along all of the length of the mattress.

6. A mattress extending along (a) a longitudinal axis by a length between a head end of the mattress and a foot end of the mattress, (b) a lateral axis perpendicular to the longitudinal axis by a width of the mattress, and (c) a third axis perpendicular to the longitudinal axis and perpendicular to the lateral axis by a thickness of the mattress, wherein the length is greater than the width, and the width is greater than the thickness, the mattress comprising:

a base portion extending along the longitudinal axis by the length and along the lateral axis by the width;

a first support section supported on the base portion;

a second support section supported on the base portion;

a third support section supported on the base portion and positioned longitudinally between the first support section and the second support section; and a comfort layer supported on the first, second, and third support sections, and extending along the longitudinal axis by the length and along the lateral axis by the width;

wherein the first support section comprises a foam material and a plurality of coil springs, and wherein the third support section comprises a plurality of coil springs.

7. The mattress of claim 6, wherein the comfort layer is a first comfort layer, and the mattress further comprises a second comfort layer supported on the first comfort layer.

8. The mattress of claim 6, wherein each of the first support section, the second support section, and the third support section extend along the lateral axis by the width.

9. The mattress of claim 6, wherein:

the first support section extends from the head end of the mattress, along the longitudinal axis, by a first distance between 15 to 19 inches; and the third support section extends from the first support section, along the longitudinal axis, by a second distance of 31 to 35 inches.

10. The mattress of claim 9, wherein the first distance is 17 inches and the second distance is 33 inches.

11. The mattress of claim 6, wherein:

the first support section extends along the third axis by a support section thickness;

the second support section extends along the third axis by the support section thickness; and the third support section extends along the third axis by the support section thickness.

12. The mattress of claim 6, wherein the third support section further comprises a foam material.

13. A mattress having a length along a longitudinal axis extending between a head end of the mattress and a foot end of the mattress, a width along a lateral axis perpendicular to the longitudinal axis, and a thickness along a third axis perpendicular to the longitudinal axis and perpendicular to the lateral axis, wherein the length is greater than the width, and the width is greater than the thickness, the mattress comprising:

a first section extending along the longitudinal axis from the head end by a first distance between 15 to 19 inches; and a second section adjacent to the first section and extending along the longitudinal axis from the first section; wherein:

the first section comprises a different material than all of the second section; and each of the first section and the second section extend along the width of the mattress.

14. The mattress of claim 13, wherein the first section and the second section together extend from the head end of the mattress, along the longitudinal axis, by a combined distance of 48 inches to 52 inches.

15. The mattress of claim 14, wherein the combined distance is 50 inches.

16. The mattress of claim 13, wherein the first distance is 17 inches.

17. The mattress of claim 13, wherein the second section extends from the first section, along the longitudinal axis, by a second distance of 31 to 35 inches.

18. The mattress of claim 17, wherein the second distance is 33 inches.

19. The mattress of claim 17, further comprising a third section extending from the second section, along the longitudinal axis, by a distance of 23 inches to 36 inches, wherein the third section comprises at least one of a foam material or one or more groups of coils.

20. The mattress of claim 13, wherein a ratio of a length of the second section along the longitudinal axis, to a length of the first section along the longitudinal axis, is between 1.9:1 and 2.1:1.

21. The mattress of claim 13, further comprising a base portion extending along the longitudinal axis by the length of the mattress and along the lateral axis by the width of the mattress, wherein the base portion supports the first section and the second section.

22. The mattress of claim 21, wherein the base portion comprises a high-density foam material or high-density fibrous fillers.

23. The mattress of claim 21, wherein the base portion comprises a plurality of coil springs oriented along the third axis.

24. The mattress of claim 13, wherein the second section comprises one or more layers of foam material.

25. The mattress of claim 13, wherein the first section comprises at least one of a foam material or one or more groups of coils.

26. The mattress of claim 13, wherein the second section comprises a plurality of coil springs.

27. The mattress of claim 26, wherein the second section extends along the longitudinal axis by a second length, and along the lateral axis by a second width, and wherein the mattress further comprises a comfort section supported on the second section and extending along the second length and the second width.

28. The mattress of claim 27, wherein the comfort section comprises a plurality of layers of foam.

29. The mattress of claim 13, further comprising a topper portion supported on the first section and the second section.

30. The mattress of claim 29, wherein the topper portion comprises one or more of a foam material, a fibrous filler, or coils.

31. The mattress of claim 29, wherein the mattress does not have a scrim material positioned between the second section and the topper portion.

32. The mattress of claim 29, wherein the topper portion is a first topper portion, the mattress further comprises a second topper portion supported on the first topper portion, and the second topper portion comprises a different material than the first topper portion.

* * * * *